US005604576A

United States Patent [19]

Inoue et al.

[11] Patent Number: 5,604,576

[45] Date of Patent: Feb. 18, 1997

[54] RECYCLE DEVELOPING METHOD AND APPARATUS

[75] Inventors: Masahide Inoue; Takeshi Arakawa; Yutaka Aso; Ryo Fujisawa, all of Osaka, Japan

[73] Assignee: Mita Industrial Co., Ltd., Osaka, Japan

[21] Appl. No.: 520,089

[22] Filed: Aug. 28, 1995

[30] Foreign Application Priority Data

Aug. 29, 1994 [JP] Japan ..... 6-203262

[51] Int. Cl.[6] ..... G03G 21/00

[52] U.S. Cl. ..... 399/255; 399/62; 399/259

[58] Field of Search ..... 355/260, 246, 355/296, 298; 430/109, 125

[56] References Cited

U.S. PATENT DOCUMENTS

| | | | |
|---|---|---|---|
| 4,768,055 | 8/1988 | Takamatsu et al. | 355/298 |
| 5,066,558 | 11/1991 | Hikake et al. | 430/109 |
| 5,289,241 | 2/1994 | Sugiyama et al. | 355/260 |
| 5,307,128 | 4/1994 | Murasaki et al. | 355/260 |
| 5,430,530 | 7/1995 | Ott et al. | 355/260 |
| 5,493,382 | 2/1996 | Takagaki et al. | 355/298 |

FOREIGN PATENT DOCUMENTS

| | | |
|---|---|---|
| 0282223 | 9/1988 | European Pat. Off. . |
| 0431930 | 6/1991 | European Pat. Off. . |

*Primary Examiner*—Robert Beatty
*Attorney, Agent, or Firm*—Sherman and Shalloway

[57] ABSTRACT

A recycle developing method utilizes the steps of (1) providing a developing vessel containing a starting developer composed of an electroscopic toner and a magnetic carrier; (2) transferring toner from the developing vessel to a photosensitive material having an electrostatic latent image formed thereon; (3) transferring a portion of the toner on the photosensitive material to a paper to form a toner image on the paper; (4) recovering toner remaining on the photosensitive material after the aforementioned portion of toner is transferred to the paper to form a toner image thereon; and (5) repeating steps (2)–(4) while replenishing toner in the developing vessel by the sub-steps of: (5*a*) supplying toner recovered in step (4) to the developing vessel, and (5*b*) supplying a virgin toner, having a higher chargeability than the electroscopic toner in the starting developer, to the developing vessel, to form a mixed toner in the developing vessel. An absolute value of the average charge quantity of the mixed toner is greater than the absolute value of the average charge quantity of the electroscopic toner in the starting developer plus 10 μC/g. Apparatus to effect the process is also disclosed.

8 Claims, 3 Drawing Sheets

RECYCLE DEVELOPING METHOD AND APPARATUS

BACKGROUND OF THE INVENTION

1. Field of the Invention

This invention relates to a recycle developing method used in an electrophotographic apparatus such as a copying machine or a printer.

2. Description of the Related Art

Generally, image formation in electrophotography is carried out by charging (main charging) the surface of a photosensitive material, imagewise exposing the charged material to form an electrostatic image on the surface of the photosensitive material, developing the image with a developer filled in a developing vessel to form a visualized toner image, transferring the toner image to a predetermined paper, and removing a toner remaining on the photosensitive material after the transferring by using a device such as a cleaning blade to complete one cycle of image forming step.

A typical developer is, for example, a two-component magnetic developer composed of an electroscopic toner made of a colored resin composition and a magnetic carrier. The developer is delivered to a developing zone in the form of a magnetic brush by means of a developer conveying sleeve provided in a developer vessel, sliding the magnetic brush with the electrostatic image on the photosensitive material, and adhering the toner to the electrostatic image to thereby perform development.

Recently, many recycle developing methods in which a toner removed and recovered by cleaning is again recirculated into a developing vessel and again used for development with an object of reutilizing toners have been proposed, and have been applied to actual electrophotographic apparatuses. This recycle developing method is applied to inexpensive low speed machines using organic photosensitive materials (OPC) in general.

In this recycle developing method, when a toner in the starting developer filled in the developing vessel is consumed and reaches a concentration of a predetermined level or below, a virgin toner is replenished from a toner feeding hopper, and a toner recovered by cleaning is also replenished.

However, in the above-mentioned recycle developing method, there is a problem in that the properties of a recovered toner to be used again after recovering by cleaning are different from the properties of a toner contained in the starting developer or those of a virgin toner supplied to a developing vessel.

For example, the surface of the toner is surface-treated with a treating agent such as silica or alumina so that its properties such as flowability may be held stably. However, the toner which is supplied for development is adhered to the surface of the photosensitive material and thereafter is recovered by cleaning, the surface treating agent is removed or embedded in the toner particles due to an external force of cleaning or to a force exerted after recovering in the step of conveying into the developing vessel, and the charged amount of the toner becomes low. Hence, as the recovered toner is replenished into the developing vessel, the charged amount of the toner in the developer becomes low, and inconveniences such as fogging or toner scattering occur.

In the developing vessel, a toner concentration sensor is provided so that the toner concentration (T/D) of a developer composed of a toner and a carrier may be controlled within a predetermined range. Controlling of this toner concentration is carried out by utilizing the variation of the toner concentration in the developer corresponding to the magnetic permeability of the developer. The magnetic permeability of the developer is detected by the toner concentration sensor and the toner is replenished into the developing vessel according to the output value of the sensor.

Changes in the properties of the developer by the replenishing of the recovered toner adversely affect the controlling of the toner concentration. For example, curve A in FIG. 3 shows the relation between the output (corresponding to the magnetic permeability of the developer) of the concentration sensor in the starting developer and the toner concentration (T/D). According to this curve, if the threshold value of ON-OFF of toner replenishing is set at a sensor output value 3 V, the toner is replenished into the developing vessel when the toner concentration becomes 3.5% or below. However, when the recovered toner is replenished into the developing vessel, the properties of the developer vary and the relation between the output of the concentration sensor and the toner concentration changes to, for example, curve B. Therefore, by the above-mentioned setting of the threshold value, it will become difficult to maintain the toner concentration at a predetermined level.

SUMMARY

It is an object of the present invention to provide a method capable of performing image formation always stably by suppressing a decrease in the properties of a developer by mixing a recovered toner, especially suppressing a decrease in the amount of charging in a recycle developing method in which a toner recovered by cleaning is circulated into a developing vessel and reused.

It is another object of the present invention to provide a method in which a toner concentration can be stably held at a predetermined level even when the recovered toner is supplied to the developing vessel in the above recycle developing method.

There is provided a recycle developing method which comprises developing an electrostatic image formed on a photosensitive material with a starting developer composed of an electroscopic toner and a magnetic carrier filled in a developing vessel to form a toner image, transferring the toner image to a predetermined paper, recovering the remaining toner on the photosensitive material by a cleaning means, and repeatedly developing the electrostatic image while replenishing a virgin toner and the toner recovered by the cleaning means; wherein the average charging amount (absolute value) of the toner in the developer containing the recovered toner is prescribed greater than the average charge quantity (absolute value) of the toner in the starting developer plus 10 μC/g.

In the present invention, the virgin toner and the recovered toner are supplied to the developing vessel based on the output of the sensor which detects the toner concentration in the developing vessel. The toner concentration is desirably controlled while the threshold value for performing ON-OFF controlling of the toner supply to the developing vessel is charged according to the operating time of image formation cycle.

DESCRIPTION OF THE PREFERRED EMBODIMENTS

Figure 1:
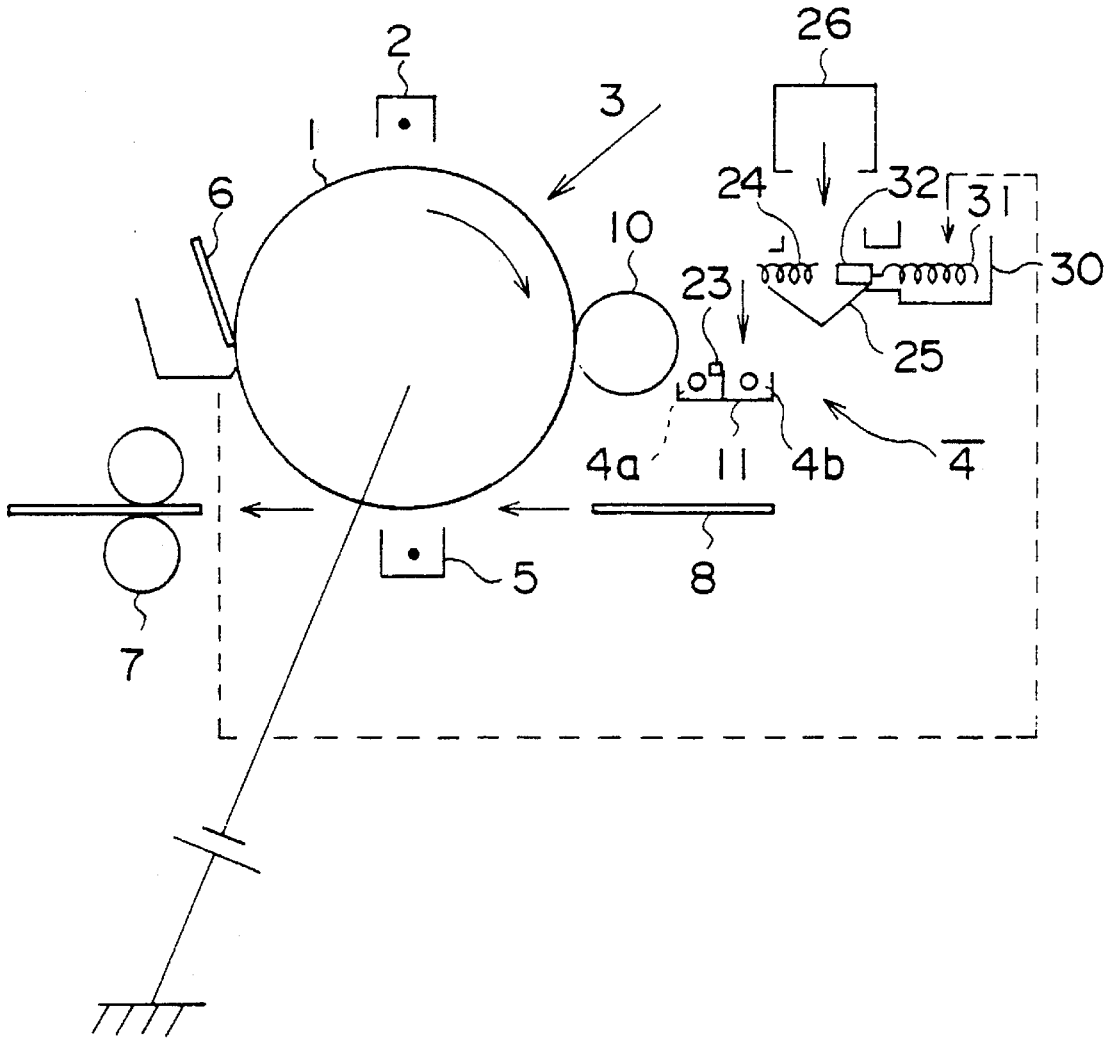
FIG. 1 shows one example of an electrophotographic apparatus for conveniently practicing the recycle developing method of the present invention.

In the recycle developing method, development in the early period is carried out by using a starting developer. When the toner has been consumed in a fixed amount by the repetition of the development, the virgin toner or the recovered toner are replenished in order to maintain the toner concentration of the developer.

In the present invention, the average charging amount (absolute value) of the toner in the developer at the time of replenishing the recovered toner in the developing vessel is prescribed greater than the average charge quantity (absolute value) of the toner in the starting developer plus 10 μC/g, whereby the decrease of the charging amount due to the mixing of the recovered toner is decreased, fogging or toner scattering is not caused, and stable image formation is made possible. For example, if the average charging amount of the toner in the developer is lower than the above-mentioned range, the mixing of the recovered toner abruptly decreases the average charging amount of the toner in the developer, and fogging or toner scattering cannot be avoided. Furthermore, the concentration of the toner in the developer to be described is difficult to maintain at a certain level.

In the present invention, it is easy to prescribe the average charge quantity of the toner in the developer containing the recovered toner by supplying the recovered toner and the replenishing virgin toner to the developing vessel and using replenishing virgin toner having a higher chargeability than the toner in the starting developer. A toner having a higher chargeability may be prepared by, for example, adjusting the amount or particle size of the surface treating agent in the toner. In this case, by prescribing the charge quantity of the toner in the starting developer (to be called "starting toner") at a low level, the preparation of a replenishing virgin toner having the charge quantity within the above-mentioned range becomes easier. The amount of the replenishing virgin toner is generally 100 to 300 parts by weight per 100 parts by weight of the recovered toner.

In the recycle developing method of the present invention, the mixing of the recovered toner relaxes a decrease in the properties of the developing agent. Therefore, the concentration of the toner in the developing agent in the developing vessel is detected by the sensor, and based on the detected concentration value, the virgin toner is replenished into the developing vessel whereby development can be carried out while maintaining the toner concentration at a fixed value. It is possible to maintain the toner concentration always at a fixed value by varying the detected value of the sensor which becomes the threshold value of ON-OFF control of the supply of the virgin toner corresponding to the operating time of image formation cycle.

Since the operating time of the image formation cycle corresponds to the operating time of a sleeve for conveying a developer provided, for example, in the developing vessel, the threshold value may be changed according to the integrated value of the driving time of a driving motor of the sleeve.

Electrophotographic Apparatus

In FIG. 1 which briefly shows one example of an electrophotographic apparatus for practicing the recycle developing method of this invention, a main charging apparatus 2, an optical system 3, a developing apparatus 4, a transferring charging apparatus 5, and a cleaning apparatus 6 such as a cleaning blade are sequentially provided around the photosensitive drum 1, and a fixing apparatus 7 is provided adjacently to the photosensitive drum 1.

The surface of the photosensitive drum 1 is charged by the main charging apparatus 2, and then imagewise exposure is performed by the optical system 3 to form an electrostatic image on the photosensitive drum 1. The electrostatic image is developed by the developing apparatus 4 to form a visualized toner image, and the toner image is transferred to a predetermined paper 8 by the transferring charging apparatus 5. The paper 8 bearing the transferred toner image is introduced into the fixing apparatus 7, and the toner image is fixed by heat, pressure, etc. on the other hand, the toner remaining on the photosensitive drum 1 after transferring is removed from the surface of the photosensitive drum 1 and recovered. In this way, one step of the image forming cycle is completed.

Developing Apparatus

The developing apparatus 4 is provided with a developer conveying sleeve 10 bearing a magnet inside and a developing vessel 11, and a developer is filled in the developing vessel 11. This developer is conveyed in the form of a magnetic brush by the sleeve 10. The magnetic brush abrades the surface of the photosensitive drum 1, and the adhesion of a charging toner to the electrostatic toner results in the formation of a toner image.

Figure 2:
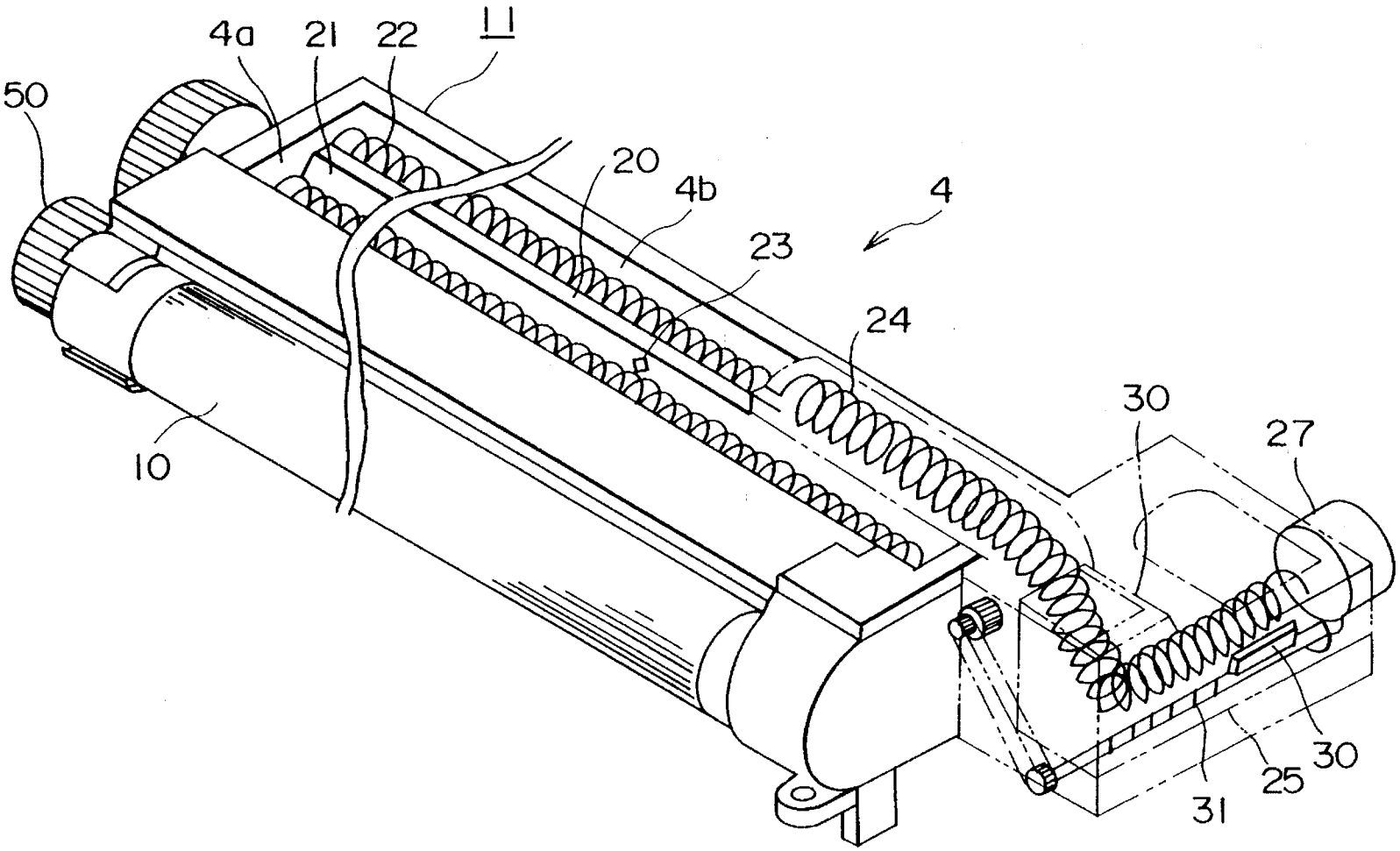
FIG. 2 shows a view depicting a main portion of the developing device used in the apparatus of FIG. 1.
Figure 3:
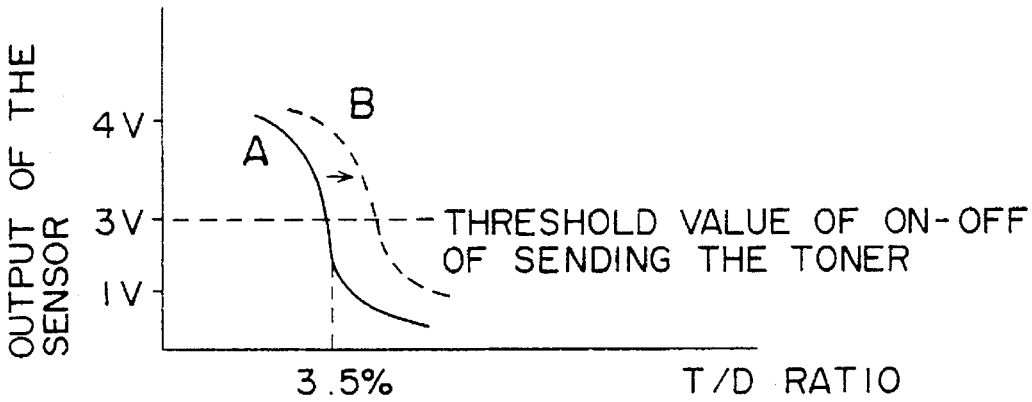
FIG. 3 is a diagram showing the relation between the output of a toner concentration sensor and the toner concentration; and, FIG. 4 is a view showing the variations of a threshold value of the output of a toner concentration sensor which performs ON-OFF control of toner replenishing in an experiment in an Example.

FIG. 2 shows the structure of the developing apparatus 4. As can be understood from FIGS. 1 and 2, the developing vessel 11 is partitioned into two chambers **4*a* and 4*b* by means of a portioning wall 20, and each chamber is provided with a spiral 21 and a spiral 22. A toner concentration sensor 23 is provided in the partitioning wall 20. Furthermore, one chamber 4*b* communicates with a toner replenishing hopper 25 having a spiral 24 built therein. The toner tank 26 filled with a replenishing virgin toner is provided in the upper portion of the hopper 25**.

The virgin toner in the toner tank 26 is supplied to the hopper 25, and is replenished into the chamber **4*b* of the developing vessel 11 by the spiral 24. The virgin toner replenished into the chamber 4*b* reciprocates between the chamber 4*b* and the chamber 4*a* by the spirals 22 and 21, and is mixed with the developer already existing in the developing vessel 11. The mixture is supplied to the sleeve 10** and used for development.

The sleeve 10 is driven and rotated by a motor 50, and the spiral 24 in the hopper 25 is driven and rotated by a motor 27 driven independently from the motor 50. The motor 27 is controlled ON-OFF by the detected out-put of the toner concentration sensor 23.

On the other hand, a recovered toner reservoir tank 30 is provided to communicate with the hopper 25, and the toner recovered by the cleaning apparatus 6 as shown above is accommodated temporarily in the reservoir tank 30 by natural falling, or suctioning.

Within the reservoir tank 30, a spiral 31 is provided in the bottom portion, and its forward end extends into the hopper 25. A paddle 32 is provided in its forward end portion, and this paddle 32 is adjacent to a spiral 24. The recovered toner is sent to the hopper 25 by the spiral 31 and the paddle 32, is mixed and stirred with the virgin toner for replenishing, and is replenished with the virgin toner into the developing vessel 11 and used for development.

Usually, the spiral 31 and the paddle 32 are adapted to be driven integrally with the sleeve 10 by a driving transmission means (for example, a worm, or a gear) linked with the driving motor 50 of the sleeve 10.

Developing Method

The recycle development using the developing apparatus 4 described above proceeds according to the following steps in terms of variations of the toner in the developer in the developing vessel 11.

(1) Development with a toner of the starting developer.

(2) Development with the toner of the starting developer+the replenishing virgin toner+the recovered toner.

(3) Development with the replenishing virgin toner+the recovered toner.

(4) Development with the recovered toner.

The replenishing virgin toner, as mentioned before, is mixed with the recovered toner in advance and the mixture is replenished into the development vessel 11. This timing of replenishing is when the toner concentration in the development vessel 11 is not larger than a fixed value. When the detected concentration output value of the toner concentration sensor 23 becomes a predetermined threshold value, the motor 27 is driven for a certain period of time, and the spiral 24 within the hopper 25 operates to supply the virgin toner into the developing vessel 11. On the other hand, the recovered toner recovered by the cleaning apparatus 6 is accommodated in the reservoir tank 30, and simultaneously with the driving of the sleeve 10, is sent to the hopper 25 by the spiral 31 and the paddle 32 driven during the developing operation, and is mixed and stirred with the virgin toner in the hopper 25. Accordingly, the recovered toner together with the virgin toner is replenished into the developing vessel 11 and used for development.

In this way, by mixing the recovered toner with the virgin toner for replenishing in advance and replenishing the mixture into the developing vessel 11, the homogeneity of the developer can be held, and it is extremely preferred to prevent an abrupt decrease in the properties of the developing agent.

In the method of this invention, it is preferred to prescribe the threshold value of ON-OFF of the replenishing of the toner into the developing vessel 11 corresponding to a copying time, for example, the integrated value of the driving time of the motor 50 for driving the sleeve 11 and vary it. Namely, the threshold value of ON-OFF is prescribed every time that the integrated value of the driving time of the motor 50 becomes a certain prescribed time. This makes it possible to replenish the recovered toner into the developing vessel 11, and even when the properties of the developing agent are varied, unless the variation in the properties is abrupt, it is possible to make an adjustment so that the toner concentration is always held at a predetermined value.

The photosensitive drum 1 may be known photosensitive members such as organic photosensitive members, amorphous selenium, and amorphous silicon. Generally, organic photosensitive members, especially single layer-type organic photosensitive members, are preferred from the standpoint of costs.

Developing Agents

In the present invention, two component-type magnetic developers composed of a toner and a magnetic carrier are used as the developing agents. As previously explained, it is important to perform development while when the recovered toner is fed into the developing vessel 11, the average charging amount of the toner of the developing agent in the developing vessel 11 is prescribed to become larger than the average charge quantity of the starting toner plus 10 μC/g. The prescribing of the charge quantity is carried out by prescribing the chargeability of the replenishing virgin toner at a higher level than the chargeability of the starting toner of the starting developing agent, and it is preferred to prescribe the charge quantity of the starting toner at a lower level.

Starting Developing Agent

The toner in the starting developing agent used is a known toner, which is prepared by dispersing toner compounding agents such as a colored pigment, a charge controlling agent, or a mold releasing agent in a fixing resin, and surface-treating the dispersion with a flowability increasing agent.

Examples of the fixing resin are those having fixability and electroscopic property such as styrene resins, a styrene-acrylic resin, polyester resins, polyurethane resins, silicone resins, polyamide resins, and modified rosins. Preferably, the styrene-acrylic resin is used.

The colored pigment is usually used in an amount of 2 to 20 parts by weight, especially 5 to 15 parts by weight, per 100 parts by weight of the fixing resin medium. Suitable examples are shown below.

Black Pigments

Carbon black, acetylene black, lamp black, and aniline black.

Yellow Pigments

Chrome yellow, zinc yellow, cadmium yellow, yellow iron oxide, Mineral Fast Yellow, nickel titanium yellow, Naples Yellow, Naphthol Yellow S, Hansa Yellow G, Hansa Yellow 10 G. Benzidine Yellow G, Benzidine Yellow GR, quinoline yellow lake, Permanent Yellow NCG, and tartrazine lake.

Orange Pigments

Chrome orange, molybdenum orange, Permanent Orange GTR, pyrazolone orange, Vulcan Orange, Indanthrene Brilliant Orange RK, Benzidine Orange G, and Indanthrene Brilliant Orange GK. (Red Pigments )

Red iron oxide, cadmium oxide, red lead, cadmium mercury sulfide, Permanent Red 4R, Lithol Red, pyrazolone red, Watchung Red Calcium Salt, Lake Red D, Brilliant Carmine 6B, eosine lake, Rhodamine Lake B, Alizarine Lake, and Briliant Carmine 3B.

Violet Pigments

Manganese violet, Fast Violet B, and methyl violet lake.

Blue Pigments

Prussian blue, cobalt blue, alkali blue lake, Victoria blue lake, phthalocyanine blue, non-metallic phthalocyanine blue, phthalocyanine blue partly chlorinated product, Fast Sky Blue and Indathrene Blue BC.

Green Pigments

Chrome green, chromium oxide, Pigment Green B, Malachite Green Lake, and Fanal Yellow Green G.

White Pigments

Zinc white, titanium oxide, antimony white and zinc sulfide.

Extender Pigments

Baryta powder, barium carbonate, clay, silica, white carbon, talc and alumina white.

Examples of the charge controlling agents include oil-soluble dyes such as Nigrosine Base (C. I. 50415), Oil Black (C. I. 26150), and spiron black, metal-containing azo dyes, metal naphthenate salts, metal salts of alkylsalicylic acids, fatty acid soaps, and resin acid soaps. The amount of such a charge controlling agent is usually 0.1 to 10 parts by weight, especially 0.5 to 5 parts by weight, per 100 parts by weight of the fixing resin.

When the toner image formed by development and transferred to a predetermined paper is to be fixed by application of heat, a mold releasing agent is compounded in order to impart mold releasability at the time of fixation by heat. As such a mold releasing agent, there are usually used polyolefin resins, such as low-molecular-weight polypropylene. The amount of the mold releasing agent used is usually 0.1 to 6 parts by weight per 100 parts by weight of the fixing resin medium.

Toner particles obtained by dispersing the toner compounding agents in the fixing resin can be produced by a pulverizing and classifying method, a melting granulation method, a spray granulating method, or a polymerization method. The pulverizing and classifying method is general. For example, the individual components of the toner are premixed in a mixer such as a Henschel mixer, and then kneaded with a biaxial extruder. The kneaded composition is cooled, pulverized and classified to form a toner.

The particle size of the toner generally is expressed by a median diameter, determined by a Coulter counter, of 5 to 15 μm, especially 7 to 12 μm.

The above-mentioned toner particles are surface-treated with a surface treating agent. Examples of the surface treating agent include a flowability improver composed of a fine powder having a particle diameter of 0.005 to 0.05 μm, for example, and a spacer particle having a particle size larger (usually, 0.05 to 1.0 μm) than the above improver.

The flowability improver increases the flowability of the toner particle, prevents the aggregation of particles with each other, and gives a fixed flowability. Examples of the flowability improver include silica powder, and fine alumina powder, and resin powders such as an acrylic resin powder, especially hydrophobic gaseous method silica surface-treated with organopolysiloxane and silazane.

The spacer particle has an action of increasing the efficiency of transfer. By outwardly adding the spacer particle, the connection of the toner and the latent image on the surface of the photosensitive material is weakened, and the peeling of the toner image is easily carried out. This increases the efficiency of transfer in the toner image transferring step. When an organic photosensitive material is used as the photosensitive material, by the outward addition of the spacer particle, the surface of the photosensitive material is abraded at the time of development, and an advantage can be obtained in that development can always be performed on a virgin surface. This spacer particle may be any organic or inorganic inert fixedly shaped particle having the above particle diameter. Generally, a magnetic powder or alumina can be used. Especially when the magnetic powder is used as the spacer particle, it is advantageous that the toner scattering can be effectively prevented. Examples of the magnetic powder which are suitable are as follows.

Tri-iron tetroxide ($Fe_3O_4$), iron sesquioxide ($\gamma$-$Fe_2O_3$), zinc iron oxide ($ZnF_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{13}$), nickel iron oxide ($NiFe_2O_4$), neodymium iron oxide ($NdFeO_3$), barium iron oxide ($BaFe_{12}O_{13}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). The magnetite (tri-iron tetroxide) is especially preferred.

In this surface treating agent, the flowability improver is generally used in an amount of 0.1 to 2.0% by weight based on the toner, and the spacer particle is generally used in an amount of 0.1 to 1.5% by weight based on the toner.

Incidentally, the amount and particle size of the surface treating agent affects the charge quantity of the toner. For example, if the amount of the surface treating agent is larger or its particle size is smaller, the charge quantity of the toner will become larger. In order to adjust the charge quantity of the toner at the time of mixing with the recovered toner to the aforesaid range, the above-mentioned amount of the surface treating agent should preferably be prescribed according to the particle size of the surface treating agent.

When the flowability improver and the spacer particle are added outwardly to the toner, the flowability improver and the spacer particle may be mixed intimate under pulverizing conditions in advance, and the entire mixture is added to the toner and fully pulverized.

Magnetic Carrier

The magnetic carrier to be used as a mixture with the aforesaid toner may be those which are known per se such as ferrite or iron powder. Its particle size is usually 50 to 120 μm, especially 85 to 105 μm.

The mixing ratio of the magnetic carrier and the toner is preferably generally 98:2 to 90:10 by weight, especially 97:3 to 92:2 by weight.

The adjustment of the charge quantity of the starting toner may be carried out by suitably selecting the mixing and stirring conditions of the magnetic carrier and the starting toner in the preparation of a starting developing agent. For example, the charge quantity of the toner increases as the mixing and stirring time of both becomes longer, but when the stirring of both is continued for some length of time, the charge quantity of the toner tends to decrease thereafter. By utilizing this fact, the charge quantity of the starting toner may be prescribed in relation to the amount and particle diameter of the surface treating agent. Generally, the charge quantity of the starting toner may preferably be prescribed within a range of 14 to 30 μC/g.

Replenishing Virgin Toner

The virgin toner to be replenished in this invention according to the consumption of the toner by development has the same composition as the starting toner excepting that its chargeability is prescribed at a high level in respect to the starting toner. The adjustment of the chargeability of the toner, as explained above, can be easily carried out by adjusting the amount used or the particle diameter of the surface treating agent. In other words, the amount of the surface treating agent is increased more than the starting toner, or a component having a smaller particle diameter is used in a larger amount as the surface treating agent whereby the chargeability of the toner can be made higher than the starting toner. If the chargeability of the replenishing virgin toner differs extremely from the starting toner, the charged amount of the toner changes abruptly when the toner is supplied into the developing vessel 11. Therefore, the chargeability of the toner is desirably made higher than the starting toner in respect of the amount of the surface treating agent, that is to say, within the range of amounts of the flowability improver having a small particle diameter and the spacer particle having a large particle diameter.

According to this invention, by using a replenishing virgin toner and supplying it together with a recovered toner into the developing vessel 11, the average charge quantity of the toner containing the recovered toner, of which charge quantity is low by removing the surface treating agent, can be made larger than that of the starting toner plus 10 μC/g. Generally, it is preferred to prescribe the average charge quantity at a value not greater than at least 20 μC/g. By this procedure, an abrupt decrease in the properties of the developing agent by the mixing of the recovered toner can be relaxed. For example, by prescribing the threshold value of ON-OFF of the feeding of the replenishing toner, the concentration of the toner can always be held at a fixed value, and it is possible to perform development stably.

EXAMPLES

The present invention will be further described by the following Examples.

EXAMPLE 1

Preparation of Toner Particles

By the following recipe, the individual agents were melt-kneaded by using a biaxial extruder. The kneaded mixture was pulverized by a jet mill and classified by a wind classifier to obtain toner particles having an average particle diameter of 10 μm.

Toner Recipe

Fixing resin: 100 parts by weight

Coloring agent: 10 parts by weight

Charge controlling agent: 1 part by weight

Mold releasing agent: 5 parts by weight

Preparation of a Surface Treating Agent

The following surface treating agent was prepared. An alumina pretreating agent was prepared by mixing alumina (made by Sumitomo Chemical Co., Ltd.: AKP-20) having a central particle diameter of 0.5 μm and a hydrophobic silica power (made by Cabbot Co.: TS-720) having a particle diameter of 0.015 μm at a weight ratio of 10:1 for 1 minute by using a vitamix.

Preparation of a Starting Toner

The above alumina pretreating agent was added in an amount of 0.5% by weight to the toner particles prepared above. The mixture was mixed for 2 minutes by a Henschel mixer to obtain an alumina-treated toner. Then, to the alumina-treated toner, 0.1% by weight of the hydrophobic silica powder used in the preparation of the surface treating agent was added. They were mixed for 2 minutes by a Henschel mixer to prepare a starting toner.

Preparation of a Starting Developing Agent

The above starting toner and a ferrite carrier (made by Powdertec Co.: FL184-150) having an average particle diameter of 80 μm in a ball mill (75 rpm, 2 hours) to prepare a starting developing agent having a toner concentration of 4.5%. The charged amount of the starting toner in this starting developing agent is shown in Table 1.

Preparation of a Replenishing Virgin Toner

The alumina pretreating agent (1.0% by weight) was added to the above prepared toner particles. The resulting product was mixed for 2 minutes by a Henschel mixer to prepare an alumina-treated toner. Then, 0.3% by weight of the hydrophobic silica powder used in the preparation of the surface treating agent was added to the alumina-treated toner, and the product was mixed for 2 minutes by a Henschel mixer to prepare a replenishing virgin toner.

Experiment

A copying machine DC-2556 made by Mita Industrial Co., Ltd. using an organic photosensitive material was remodelled into a recycle-type machine shown in FIG. 1. Using the above starting toner and the replenishing virgin toner, 30,000 sheets were copied continuously under the following conditions, and fogging and toner scattering were evaluated. The results are shown in Table 1. Photosensitive drum (mono-dispersed type organic photosensitive material )

Thickness of the photosensitive layer: 30 μm Binder resin: polycarbonate

Charge generating agent: Perylene pigment (5% by weight based on the resin)

Charge transporting agent: ethyl carbazole hydrazone (90% by weight based on the resin)

Drum diameter: 78 mm

Development sleeve diameter: 34 mm

Distance between drum and sleeve: 0.75 mm

Surface potential of the photosensitive material: 800 V

Bias voltage between drum and sleeve: 290 V

Drum/sleeve peripheral speed ratio: 2.89

Figure 4:
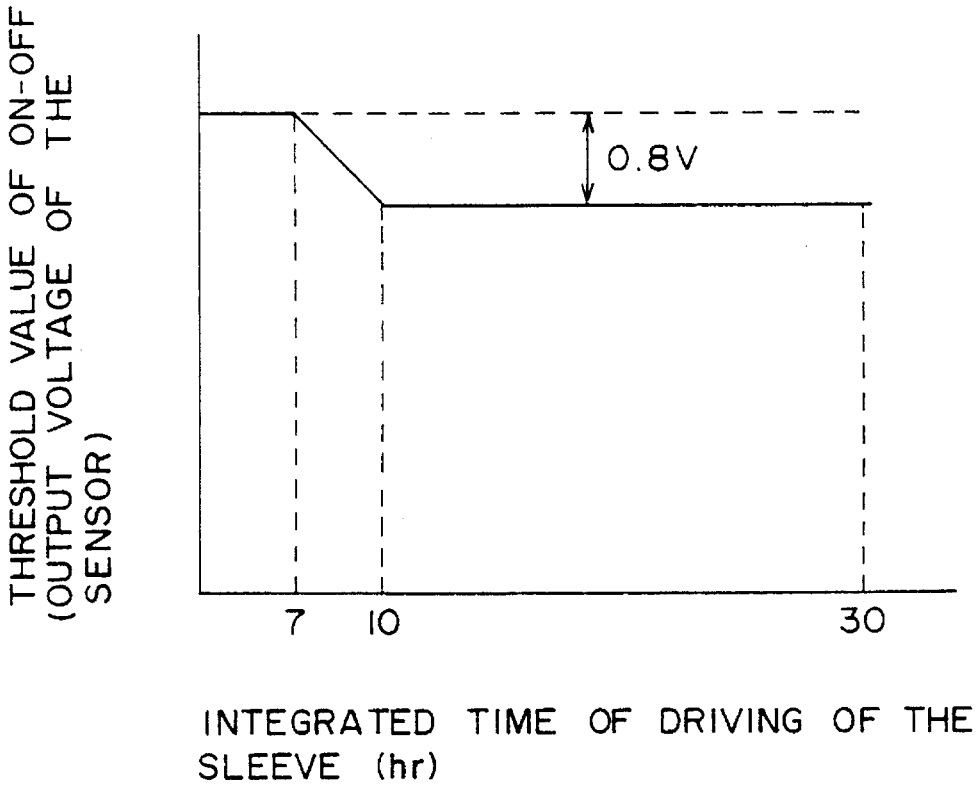

The toner concentration was controlled by varying the ON-OFF control threshold value of the replenishing of the toner by the output of the sensor in accordance with the flowchart shown in FIG. 4. The virgin toner was replenished with the recovered toner in an amount of 100 to 300 parts by weight per 100 parts by weight of the recovered toner.

Fogging

It was shown by the fogging concentrations on the images of the first sheet (early period), 15,000th sheet and 30,000th sheet. Toner scattering:

The degrees of toner scattering on the images within the machine after the end of experimentation and in the 30,000th sheet were judged by the eyes, and evaluated by the following standards.

○: No toner scattering

Δ: Toner scattering was slightly recognized, but no adverse effect was shown in the image.

X: Toner scattering developed to such an extent that toner dropping on the image was noted.

During the above experiment, the charged amount of the toner in the toner within the developing vessel was measured on every 1,000 sheets, and the average charged amount was measured. The results are shown in Table 1.

From 4,000th sheet, the recovered toner and the replenishing virgin toner were supplied into the developing vessel.

EXAMPLE 2

The replenishing virgin toner in Example 1 was used as the starting toner, and this starting toner was mixed with a ferrite carrier having an average particle diameter of 80 μm by a ball mill at 75 rpm for 4 hours to prepare a starting developing agent having a toner concentration of 4.5%. The charge quantity of the starting toner in the starting developing agent is shown in Table 1.

The same experiment as in Example 1 was performed except that the above starting developing agent was used. The results are shown in Table 1.

EXAMPLE 3

Preparation of the Starting Toner

The alumina pretreating agent (1.0% by weight) was mixed with the toner particles prepared in Example 1 for 2 minutes by a Henschel mixer to obtain an alumina-treated toner. Then, 0.3% by weight of hydrophobic silica powder used in the preparation of the surface treating agent and 0.2% by weight of positively charged acrylic fine powder (average particle diameter 0.5 μm, made by Soken Chemical Co., Ltd., MP-5500) were mixed with each other for 2 minutes by a Henschel mixer to prepare a starting toner.

Starting Toner Developing Agent

A starting developing agent was prepared in the same way as in Example 1 except that the above starting toner was used. The charge quantity of the starting toner in this developing agent is shown in Table 1.

Preparation of a Replenishing Virgin Toner

The alumina pretreating agent (1.0% by weight) was mixed with the toner particles prepared in Example 1 for 2 minutes by using a Henschel mixer to obtain an alumina pretreating agent. The hydrophobic silica powder (0.3% by weight) used in the preparation of the surface treating agent was mixed with the alumina-treated toner by using a Henschel mixer for 2 minutes to prepare a replenishing virgin toner.

Experiment

Using the following starting developing agent and replenishing virgin toner, the experiment was conducted in the same way as in Example 1. The results are shown in Table 1.

COMPARATIVE EXAMPLE 1

The experiment was used in the same way as in Example except that the same replenishing virgin toner was used in Example 1 as a starting toner. The results are shown in Table 1.

COMPARATIVE EXAMPLE 2

A starting toner was used in Example 1 as the replenishing virgin toner. The charged amount of the starting toner in the developing agent is shown in Table 1.

The experiment was conducted in the same way as in Example 1 except that the above starting developing agent was used and the starting toner of Example 1 was used as the replenishing virgin toner. The results are shown in Table 1.

TABLE 1

| | Example | | | Comparative Example | |
|---|---|---|---|---|---|
| | 1 | 2 | 3 | 1 | 2 |
| Charge quantity (μC/g) starting toner (A) | −19.0 | −23.5 | −17.8 | −25.0 | −25.0 |
| average charge quantity at running | −34.2 | −35.6 | −31.4 | −33.9 | −28.2 |
| \|A-B\| | 15.2 | 12.1 | 13.6 | 8.9 | 3.2 |
| Fogging | | | | | |
| first sheet | 0.000 | 0.000 | 0.000 | 0.000 | 0.000 |
| 15,000th sheet | 0.002 | 0.004 | 0.003 | 0.006 | 0.009 |
| 30,000th sheet | 0.003 | 0.003 | 0.003 | 0.006 | 0.010 |
| Toner scattering | ○ | ○ | ○ | X | X |

EXAMPLE 4

Preparation of a Starting Toner

Magnetite (BL-220 made by Titanium Industry) having a central particle diameter of 0.3 μm was mixed with hydrophobic silica powder (made by Cabbot Company under the tradename of "TS-720") having a central particle diameter of 10:1 by weight to prepare a surface treating agent.

The surface treating agent (0.25% by weight) was added to the toner particles prepared in Example 1. A mixture of 1:3 (weight ratio ) of alumina particles having a central particle diameter of 0.015 μm and the hydrophobic silica powder ("TS-720") was added in an amount of 0.20% by weight to the surface-treated toner to form a starting toner.

Preparation of a Starting Developing Agent

The above starting toner was mixed with a ferrite carrier having an average particle diameter of 80 μm (Powder Tec Co., Ltd. available under the tradename of "FL184-150") in a ball mill at a rotating speed of 75 rpm for 4 hours to give a starting developing agent having a toner concentration of 4.5%.

Preparation of a Replenishing Virgin Toner

Alumina particles (0.33% by weight) having a central particle diameter of 0.015 μm and the hydrophobic silica powder (0.17% by weight; "TS-720") were added to the toner particles prepared in Example 1, and the product was prepared by mixing them for 2 minutes by a Henschel mixer to give a replenishing virgin toner.

Experiment

Using the starting developing agent and the replenishing virgin toner prepared above, the same experiment as in Example 1 was carried out under the following conditions. The results are shown in Table 2.

Organic photosensitive drum: The same as used in Example 1 except that the diameter of the drum was changed to 30 mm.

Diameter of the development sleeve: 20 mm

Distance between drum and sleeve: 0.65 mm

Peripheral speed ratio between drum and sleeve: 3.0

Surface potential of the photosensitive material: 800 V

Bias voltage: 300 V

EXAMPLE 5

Preparation of a Starting Toner

Alumina having an average particle diameter of 0.015 μm (aluminum oxide C made by Japan Aerosil Co., Ltd. ) was mixed with hydrophobic silica fine powder having an average particle diameter of 0.015 μm (TS-720 made by Cabbot Company) at a weight ratio of 1:1 for 1 minute by using a vita mix to give a surface treating agent.

The above surface treating agent (1.0% by weight) and 0.2% by weight of magnetite having an average particle diameter of 0.3 μm were added to the toner particles prepared above. They were mixed by a Henschel mixer for 2 minutes to obtain a surface treated toner (alumina content: 0.5% by weight, silica content: 0.5% by weight).

Preparation of a Starting Developing Agent

The surface-treated toner obtained above was mixed with a ferrite carrier having an average particle diameter of 80 μm in a ball mill at a speed of 75 rpm for 4 hours to give a starting developing agent having a toner concentration of 4.5%.

Preparation of a Replenishing Virgin Toner

A replenishing starting toner was prepared in the same manner as the starting toner except that magnetite was not added.

Experiment

Using the above starting developing agent and replenishing virgin toner, the experiment was carried out under the same developing conditions as in Example 4. The results are shown in Table 2.

EXAMPLE 6

Preparation of a Starting Developing Agent

A starting toner was prepared in the same way as in Example 5 except that the amount of the surface treating agent was changed to 0.1% by weight. A starting developing agent was prepared in the same way as in Example 5, except that the above starting toner.

Preparation of a Replenishing Virgin Toner

A replenishing virgin toner was prepared in the same way as in Example 5 except that the amount added of the surface treating agent was changed to 0.1% by weight.

Experiment

Using the above starting developing agent and replenishing virgin toner, the experiment was carried out under the same developing conditions as in Example 4. The results are shown in Table 2.

EXAMPLE 7

Preparation of a Starting Developing Agent

A starting developing agent was prepared in the same way as in Example 5 using the starting toner as prepared in Example 5 except that a surface treating agent as prepared by changing the weight ratio of the alumina and the silica fine powder to 2:1.

Preparation of a Replenishing Virgin Toner

A replenishing virgin toner was prepared in the same way as the starting toner except that magnetite was not added.

Experiment

Using the above starting toner and replenishing virgin toner, the experiment was carried out under the same developing conditions as in Example 4. The results are shown in Table 2.

EXAMPLE 8

In Example 7, a starting developing agent was prepared using a starting toner prepared by changing the amount of the surface treating agent to 0.1% by weight. The same experiment as in Example 7 was carried out except the starting developing agent was used. The results are shown in Table 2.

TABLE 2

| | Example | | | | |
|---|---|---|---|---|---|
| | 4 | 5 | 6 | 7 | 8 |
| Charge quantity (μC/g) starting toner (A) | −19.8 | −23.7 | −21.5 | −20.1 | −19.3 |
| average charge quantity at running | −30.2 | −37.1 | −33.7 | −31.5 | −29.8 |
| \|A-B\| | 10.4 | 13.4 | 12.2 | 11.4 | 10.5 |
| Fogging | | | | | |
| first sheet | 0.001 | 0.001 | 0.002 | 0.001 | 0.001 |
| 15,000th sheet | 0.002 | 0.002 | 0.000 | 0.002 | 0.001 |
| 30,000th sheet | 0.002 | 0.002 | 0.003 | 0.003 | 0.001 |
| Toner scattering | ○ | ○ | ○ | ○ | ○ |

According to the present invention, the recycle development was carried out by prescribing the average charge quantity of the toner in the developer containing the recovered toner greater than the average charge quantity of the toner in the starting developing agent plus 10 μC/g, whereby an abrupt decrease in the charge quantity of the developing agent due to the mixing of the recovered toner is relaxed. As a result, stable images free from fogging or toner scattering by the recycle development can be formed. Furthermore, the threshold value of the output of the sensor of ON-OFF control of replenishing the toner into the developing agent is adjusted by the time of forming an image. Even when the recovered toner is used, a fixed toner concentration can always be maintained.

We claim:

1. A recycle developing method comprising the steps of:

(1) providing a developing vessel containing a starting developer comprised of an electroscopic toner and a magnetic carrier;

(2) transferring toner from said developing vessel to a photosensitive material having an electrostatic latent image formed thereon;

(3) transferring a portion of said toner on said photosensitive material to a paper to form an image on said paper;

(4) recovering toner remaining on said photosensitive material after said portion of toner is transferred to said paper;

(5) repeating steps (2)–(4) while replenishing toner in said developing vessel by the sub-steps of:

(*5a*) supplying said toner recovered in step (4) to said developing vessel, and (*5b*) supplying a virgin toner, having a higher chargeability than said electroscopic toner in said starting developer, to said developing vessel, said sub-steps (*5a*) and (*5b*) cooperating so as to form a mixed toner in said developing vessel, an absolute value of the average charge quantity of said mixed toner being greater than the absolute value of the average charge quantity of said electroscopic toner in said starting developer plus 10 μC/g.

2. A recycle developing method of claim 1 wherein the average charge quantity (absolute value) of the toner in the developing agent containing the recovered toner is not prescribed at a value greater than the average charging amount of the toner in the starting developing agent plus 20 μC/g.

3. A recycle developing method of claim 1 wherein the toner in the starting developing agent and the replenishing virgin toner are surface-treated with a surface treating agent, and the chargeability of the replenishing virgin toner is adjusted according to the particle diameter and amount of the surface treating agent.

4. A recycle developing method of claim 1 wherein the toner is supplied into the developing vessel according to the output of the sensor for detecting the toner concentration of the developing agent in the developing vessel, and the threshold value for performing ON-OFF control of the supply of the toner is changed corresponding to the action time of image forming cycle.

5. A recycle developing apparatus comprising:

a developing vessel containing a starting developer comprised of an electroscopic toner and a magnetic carrier;

a first transferring means for transferring toner from said developing vessel to a photosensitive material having an electrostatic latent image formed thereon;

a second transferring means for transferring a portion of said toner on said photosensitive material to a paper to form an image on said paper;

a recovering means for recovering toner remaining on said photosensitive material after said portion of toner is transferred to said paper;

a toner tank holding a quantity of a virgin toner; and a supplying means for supplying said virgin toner from said toner tank to said developing vessel together with the toner recovered by said recovering means so as to form a mixed toner in said developing vessel;

wherein the virgin toner has a higher chargeability than the electroscopic toner in the starting developer, and an absolute value of the average charge quantity of the mixed toner is greater than the absolute value of the average charge quantity of said electroscopic toner in the starting developer plus 10 μC/g.

6. The recycle developing apparatus of claim 5, wherein the absolute value of the average charge quantity of the mixed toner is not greater than the absolute value of the average charge quantity of the electroscopic toner in the starting developer plus 20 μC/g/.

7. The recycle developing apparatus of claim 5, wherein the electroscopic toner in the starting developer and the virgin toner are surface-treated with a surface treating agent, and the chargeability of the virgin toner is adjusted according to the particle diameter and amount of the surface treating agent.

8. The recycle developing apparatus of claim 5 further comprising a sensor for detecting toner concentration of the developer in the developing vessel, wherein the toner is supplied by the supplying means into the developing vessel according to an output of said sensor, and a threshold value for performing ON-OFF control of the supply of the toner is changed corresponding to the action time of image forming cycle.

* * * * *